US011504732B1

(12) United States Patent
Scepaniak

(10) Patent No.: US 11,504,732 B1
(45) Date of Patent: Nov. 22, 2022

(54) SPRAY MACHINE

(71) Applicant: Kurtis D. Scepaniak, Cold Spring, MN (US)

(72) Inventor: Kurtis D. Scepaniak, Cold Spring, MN (US)

( * ) Notice: Subject to any disclaimer, the term of this patent is extended or adjusted under 35 U.S.C. 154(b) by 0 days.

(21) Appl. No.: 16/865,256

(22) Filed: May 1, 2020

Related U.S. Application Data

(60) Provisional application No. 62/946,857, filed on Dec. 11, 2019, provisional application No. 62/841,808, filed on May 1, 2019.

(51) Int. Cl.

| | |
|---|---|
| ***B05B 13/00*** | (2006.01) |
| ***B05B 1/20*** | (2006.01) |
| ***B05B 12/08*** | (2006.01) |
| ***B05B 12/12*** | (2006.01) |

(52) U.S. Cl.
CPC ..... *B05B 13/005* (2013.01); *B05B 1/20* (2013.01); *B05B 12/084* (2013.01); *B05B 12/122* (2013.01)

(58) Field of Classification Search
USPC ..... 118/313, 315, 712
See application file for complete search history.

(56) References Cited

U.S. PATENT DOCUMENTS

| | | | |
|---|---|---|---|
| 166,296 | A | 8/1875 | Perry |
| 1,316,937 | A | 9/1919 | Brewster |
| 2,111,761 | A | 3/1938 | Eckert |
| 3,189,498 | A | 6/1965 | Rapp |
| 3,477,352 | A | 11/1969 | Harding et al. |
| 3,886,011 | A | 5/1975 | Eigenmann |
| 3,954,544 | A | 5/1976 | Hooker |
| 4,087,296 | A | 5/1978 | Hooker |
| 4,093,411 | A | 6/1978 | Lee |
| 4,333,973 | A | 6/1982 | Bellafiore et al. |
| 4,376,007 | A | 3/1983 | Eigenmann |
| 4,537,796 | A | 8/1985 | Buys et al. |
| 5,011,078 | A | 4/1991 | Eisterhold |
| 5,109,790 | A | 5/1992 | Matsumoto et al. |
| 5,109,791 | A | 5/1992 | Matsumoto et al. |
| 5,279,684 | A | 1/1994 | Retti |
| 5,279,700 | A | 1/1994 | Retti |
| 5,670,178 | A | 9/1997 | West |
| 5,730,819 | A | 3/1998 | Retti |
| 6,024,147 | A | 2/2000 | Hunter, Jr. |
| 6,036,123 | A | 3/2000 | West |
| 6,047,902 | A | 4/2000 | Hofmann |

(Continued)

*Primary Examiner* — Yewebdar T Tadesse
(74) *Attorney, Agent, or Firm* — Albert W. Watkins

(57) ABSTRACT

A spray machine autonomously traverses a roof while selectively spraying and rolling adhesive across the roof. To navigate the roof, the spray machine is most preferably fitted with GPS and other sensors to detect roof features and already coated adhesive. In one embodiment the spray machine has a spray and roll apparatus supported on an undercarriage and propelled by a drive train. Each of the spray nozzles and rollers are preferably supported upon respective boom arms, and reciprocate along the longitudinal axis of the boom arm. Each of the spray and roller boom arms have a longitudinal axis that extends transverse to the spray machine ordinary forward direction of travel. In another embodiment, combination spray and roller boom arms are hinged to the undercarriage, and so may be lifted from horizontal to vertical to avoid obstacles.

5 Claims, 3 Drawing Sheets

(56) References Cited

U.S. PATENT DOCUMENTS

| | | | | |
|---|---|---|---|---|
| 6,090,203 | A | 7/2000 | Gebhardt et al. | |
| 6,117,256 | A | 9/2000 | Hunter | |
| 6,126,766 | A | 10/2000 | Hunter, Jr. | |
| 6,358,344 | B1 | 3/2002 | Hunter, Jr. | |
| 6,416,854 | B2 | 7/2002 | Hunter | |
| 6,484,781 | B2 | 11/2002 | Weaver | |
| 6,540,423 | B1 | 4/2003 | Kugler et al. | |
| 6,817,798 | B2 | 11/2004 | Kugler et al. | |
| 6,981,657 | B1 | 1/2006 | West | |
| 7,014,714 | B2 | 3/2006 | Buckley et al. | |
| 7,118,629 | B2 | 10/2006 | Davidson | |
| 7,347,244 | B2 | 3/2008 | Vaillancourt | |
| 7,611,583 | B2 | 11/2009 | Buckley et al. | |
| 8,535,461 | B1 | 9/2013 | Godbehere | |
| 8,998,600 | B1 | 4/2015 | Lee | |
| 9,795,984 | B2 | 10/2017 | Hoppel et al. | |
| 10,618,179 | B1 * | 4/2020 | See | B25J 5/007 |
| 2002/0108692 | A1 | 8/2002 | Hunter | |
| 2007/0267524 | A1 * | 11/2007 | Mack | A01G 25/092 239/729 |
| 2013/0122186 | A1 | 5/2013 | Hoppel | |
| 2013/0206063 | A1 * | 8/2013 | Van Rensburg | B05B 7/0408 118/712 |
| 2018/0093289 | A1 | 4/2018 | Raman et al. | |
| 2019/0047010 | A1 * | 2/2019 | Barker | B64C 39/024 |
| 2019/0059351 | A1 * | 2/2019 | Brooks | A01M 7/0057 |

* cited by examiner

SPRAY MACHINE

CROSS REFERENCE TO RELATED APPLICATIONS

The present application claims the benefit of U.S. provisional patent application 62/946,857 filed Dec. 11, 2019, and also claims the benefit of US provisional patent application 62/841,808 filed May 1, 2019, each of like title and inventorship, the teachings and entire contents which are incorporated herein by reference.

BACKGROUND OF THE INVENTION

1. Field of the Invention

The present invention pertains generally to the commercial construction industry, and more specifically to the construction and maintenance of a commercial roof. In a particular manifestation, the present invention provides an automated apparatus for applying adhesive to the surface of a commercial roof.

2. Description of the Related Art

Constructing commercial roofs is a labor intensive and time consuming process. The roof may for exemplary and non-limiting purpose be constructed of a plurality of layers, such as tar or other bituminous materials, polymer or rubber sheets, insulation, and other beneficial materials. These layers are applied and in many but not all cases may be glued or otherwise adhered together and down to the roof structure.

In at least some instances, the adhesives that may be preferred are recommended by the manufacturer to be sprayed and then spread using a roller. Unfortunately, spraying followed by rolling effectively requires two persons, or a single person to repeatedly switch between using and then storing the sprayer and using and then storing the roller. As can be appreciated, a single person will not only spend a substantial fraction of their time picking up and setting down tools, there will also be a significant delay between the spraying and rolling procedures. In addition, and whether with one or two persons, there will be significant walking through already applied adhesive.

A consistent and complete application is highly desired. Nevertheless, as noted this is challenging even for two persons.

While automated spray applicators exist, the environment of the roof also presents challenges. There are almost always many obstacles, such as stacks, vents, skylights, and the like that pass through the roof surface, and HVAC and other equipment that is permanently located upon the roof. As a result, even with a simple rectangular outline, a roof is rarely traversed in a simple back and forth pattern without the need to redirect around an obstacle.

Exemplary U.S. patents and published applications of varying relevance, the relevant teachings which are incorporated herein by reference, include: U.S. Pat. No. 166,296 by Perry, entitled "Mode of securing flexible roofing to roofs"; U.S. Pat. No. 1,316,937 by Brewster, entitled "Air brush"; U.S. Pat. No. 2,111,761 by Eckert, entitled "Process and apparatus for coating roofing"; U.S. Pat. No. 3,189,498 by Rapp, entitled "Roofing method"; U.S. Pat. No. 3,477,352 by Harding et al, entitled "Self-propelled apparatus for applying markings to roads and the like"; U.S. Pat. No. 3,886,011 by Eigenmann, entitled "Apparatus and procedure for applying marking stripes"; U.S. Pat. No. 3,954,544 by Hooker, entitled "Foam applying apparatus"; U.S. Pat. No. 4,087,296 by Hooker, entitled "Method for applying membrane-covered rigid foam to building surface"; U.S. Pat. No. 4,093,411 by Lee, entitled "Apparatus for applying foamed material in-place to surfaces"; U.S. Pat. No. 4,333,973 by Bellafiore et al, entitled "Insulating machine and process"; U.S. Pat. No. 4,376,007 by Eigenmann, entitled "Machine for preparing road surfaces and forming traffic regulating lines thereon"; U.S. Pat. No. 4,537,796 by Buys et al, entitled "Method for treating the surface of a concrete slab"; U.S. Pat. No. 5,011,078 by Eisterhold, entitled "Surface marking method to obtain uniform coating"; U.S. Pat. No. 5,109,790 by Matsumoto et al, entitled "Floor coating agent applying machine"; U.S. Pat. No. 5,109,791 by Matsumoto et al, entitled "Floor coating liquid applying machine"; U.S. Pat. No. 5,279,684 by Retti, entitled "Wallboard taping process"; U.S. Pat. No. 5,279,700 by Retti, entitled "Automated wallboard taping apparatus and process therefor"; U.S. Pat. No. 5,670,178 by West, entitled "Method and apparatus for applying foam plastic materials to a roof deck"; U.S. Pat. No. 5,730,819 by Retti, entitled "Dispensing apparatus and method for dispensing fluid material to a surface"; U.S. Pat. No. 6,024,147 by Hunter, Jr., entitled "Spray applicator for roofing and other surfaces"; U.S. Pat. No. 6,036,123 by West, entitled "Apparatus for applying foam material to a substrate"; U.S. Pat. No. 6,047,902 by Hofmann, entitled "Road marking machine with a pump combination driven in proportion with the traveling speed"; U.S. Pat. No. 6,090,203 by Gebhardt et al, entitled "Bowling Lane oil application device and method"; U.S. Pat. No. 6,117,256 by Hunter, entitled "Method of applying spray-applied foam to roofing and other surfaces"; U.S. Pat. No. 6,126,766 by Hunter, Jr., entitled "Method of applying a spray-applied foam to roofing and other surfaces"; U.S. Pat. No. 6,358,344 by Hunter, Jr., entitled "Spray applicator for roofing and other surfaces"; U.S. Pat. No. 6,416,854 by Hunter, entitled "Monolithic roofing surface membranes and applicators and methods for same"; U.S. Pat. No. 6,484,781 by Weaver, entitled "Cold process roofing felt applicator"; U.S. Pat. No. 6,540,423 by Kugler et al, entitled "Method and apparatus for applying mastic or granular material to a roofing surface"; U.S. Pat. No. 6,817,798 by Kugler et al, entitled "Method and apparatus for applying mastic or granular material to a roofing surface"; U.S. Pat. No. 6,981,657 by West, entitled "Apparatus for applying foam material to a substrate"; U.S. Pat. No. 7,014,714 by Buckley et al, entitled "Apparatus and method for conditioning a bowling lane using precision delivery injectors"; U.S. Pat. No. 7,118,629 by Davidson, entitled "Apparatus for applying a coating to a roof or other substrate"; U.S. Pat. No. 7,347,244 by Vaillancourt, entitled "Membrane applicator"; U.S. Pat. No. 7,611,583 by Buckley et al, entitled "Apparatus and method for conditioning a bowling lane using precision delivery injectors"; U.S. Pat. No. 8,535,461 by Godbehere, entitled "Melted hot glue system for applying broadcast soil fumigation film to an agricultural field"; U.S. Pat. No. 8,998,600 by Lee, entitled "Apparatus for applying foamed material in-place to surfaces"; U.S. Pat. No. 9,795,984 by Hoppel et al, entitled "Method and apparatus for coating horizontal surfaces"; 2002/0108692 by Hunter, entitled "Spray applicator for roofing and other surfaces"; 2013/0122186 by Hoppel, entitled "Method and apparatus for coating horizontal surfaces"; and 2018/0093289 by Raman et al, entitled "Autonomous painting systems and related methods".

As may be apparent, in spite of the enormous advancements and substantial research and development that has been conducted, there still remains a need for an improved autonomous apparatus for applying adhesive to the surface of a commercial roof.

In addition to the foregoing patents, Webster's New Universal Unabridged Dictionary, Second Edition copyright 1983, is incorporated herein by reference in entirety for the definitions of words and terms used herein.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
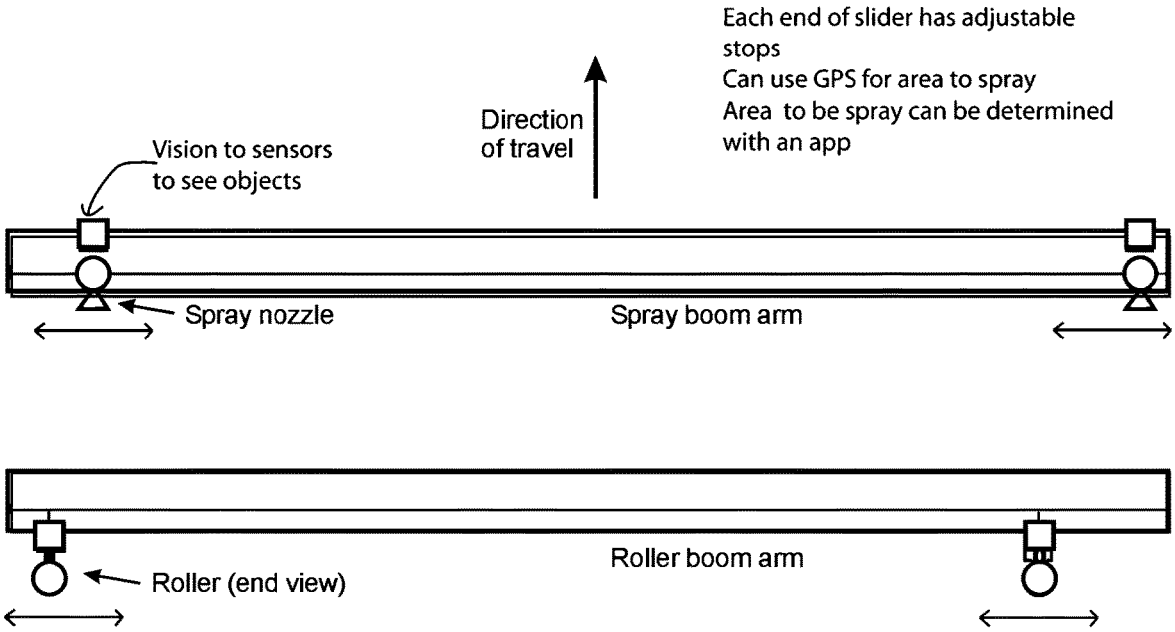
FIG. 1 illustrates preferred embodiment spray and roller boom arms designed in accord with the teachings of the present invention from a rear elevational view.

Manifested in the preferred and alternative embodiments, a spray machine designed in accord with the teachings of the present invention traverses a roof while selectively spraying and rolling adhesive across the roof. The present invention is designed to remove a substantial portion of the time consuming process of applying adhesive to a commercial roof, and replace this labor with a spray machine. To navigate the roof, the spray machine is most preferably fitted with GPS and other sensors. Through the detection of roof features and already coated adhesive, the spray machine is configured to autonomously or through remote control apply adhesive to the roof, and completely cover the roof in a consistent layer. To prevent locally overloading the roof structure, the spray machine has a limited capacity which may for exemplary and non-limiting purpose be regularly refilled either autonomously or manually.

In a preferred embodiment of the invention illustrated in the Figures, the spray machine is comprised of a spray and roll apparatus supported on an undercarriage and propelled by a drive train. Each of the spray nozzles and rollers are preferably supported upon respective boom arms, and reciprocate along the longitudinal axis of the boom arm. Each of the spray and roller boom arms have a longitudinal axis that extends transverse to the spray machine ordinary forward direction of travel.

Any suitable drive apparatus may be provided to reciprocate the spray nozzles along the spray boom arm and to reciprocate the rollers along the roller boom arm. For exemplary and non-limiting purpose, such actuators may include motor-coupled cables or belts strung in an extremely elongated oval from end to end on the boom arm, supported thereon with suitable rollers in the manner of an ink jet print head. In alternative embodiments, linear actuators or motors that are electrically, hydraulically, pneumatically, or otherwise powered may be used to reciprocate the spray nozzles and rollers.

As the spray machine travels forward across a roof, the spray nozzles and rollers will reciprocate along an axis transverse to the direction of travel, effectively sweeping left and right. The spray machine forward motion and nozzle and roller transverse reciprocation can occur sequentially or simultaneously. In other words, in some embodiments the spray machine may step forward while the spray nozzles and rollers are idle relative to their respective boom arms. Once the spray machine has stepped sufficiently forward, the spray machine may then stop, and the spray nozzles and rollers are then driven to reciprocate relative to their respective boom arms. In other embodiments, the spray machine travels continuously forward, while the spray nozzles and rollers are simultaneously driven to reciprocate relative to their respective boom arms. In the case of simultaneous movement, and where consistent quantities of material are desired to be applied, spray volumes may be calculated to ensure overlap does not result in thicker and thinner regions of application.

In order to navigate roof obstacles, the spray and roller boom arms are preferably significantly wider than the undercarriage. In addition, the spray and roller boom arms are also preferably adjustable relative to the undercarriage. In one embodiment, the spray and roller boom arms may be shifted along their longitudinal axis, effectively either to the right or left of the undercarriage. Most preferably, either inherent in the shifting apparatus or through the further inclusion of sensors, as a boom arm is shifted the start and end points for associated rollers or spray nozzles will also be readjusted. For example, and not limiting the present invention solely thereto, if the boom arm is shifted 4" to the right, the right side spray nozzle may be adjusted to stop 4" earlier when reciprocating to the right. This avoids overspray or re-rolling already treated surfaces.

Figure 4:
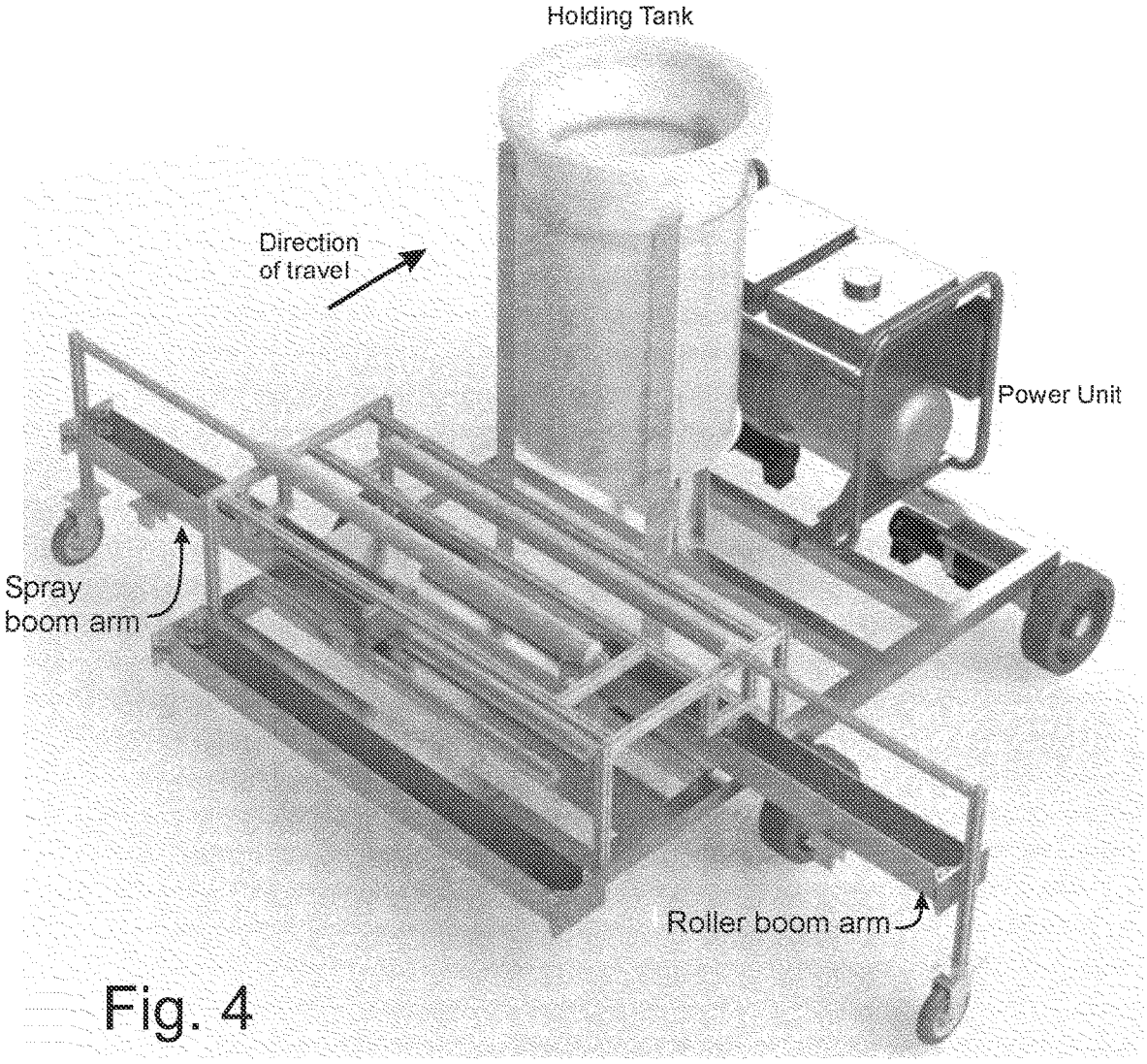
FIG. 4 illustrates a first alternative embodiment spray machine from a projected or isometric view showing alternative drive cylinders and spray boom arms.

In a second embodiment, rather than shifting the entire boom arm relative to the undercarriage, portions of the boom arm may be extensible and retractable. In some embodiments this will be accomplished through suitable drive means directly coupled to differentially move a portion of the boom arm, such as by the provision of a telescopic connection or linear bearing, and a suitable drive such as a rack-and-pinion drive or any of the aforementioned and other known types of linear actuators. FIG. 4 illustrates one such embodiment.

Figure 2:
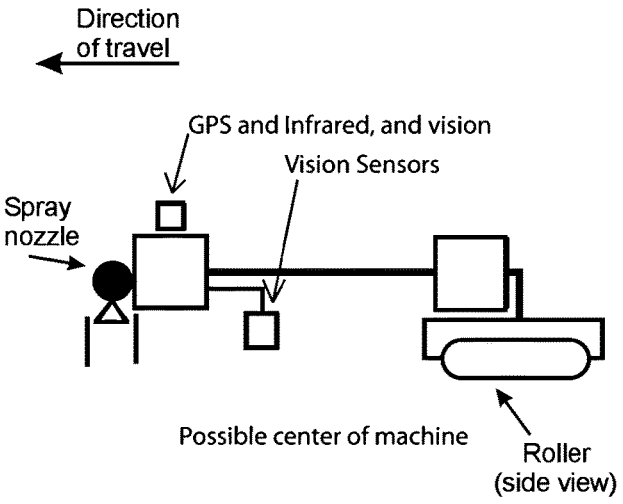
FIG. 2 illustrates a preferred embodiment spray machine from a side elevational and simplified view with the drive train and undercarriage removed.

As apparent from FIGS. 1 and 2, the spray nozzles will reciprocate on the spray boom arm while spraying adhesive, thereby applying the adhesive to the roof surface. Subsequent thereto, but very shortly thereafter, the rollers will traverse the freshly sprayed adhesive.

In some alternative embodiments, the roller may be rotated in a horizontal plane ninety degrees from that illustrated in FIGS. 1 and 2. The roller will then extend longitudinally in a direction transverse to the direction of travel. In such case, the roller will not be required to reciprocate along an axis transverse to the direction of travel. However, in such case a mechanism to extend, retract, or shift the roller will preferably be provided to enable the roller to be shifted in advance of an obstacle. In one alternative embodiment, the roller may be divided into sections, and the outer sections may be shifted and selectively enabled or disabled as required.

Figure 5:
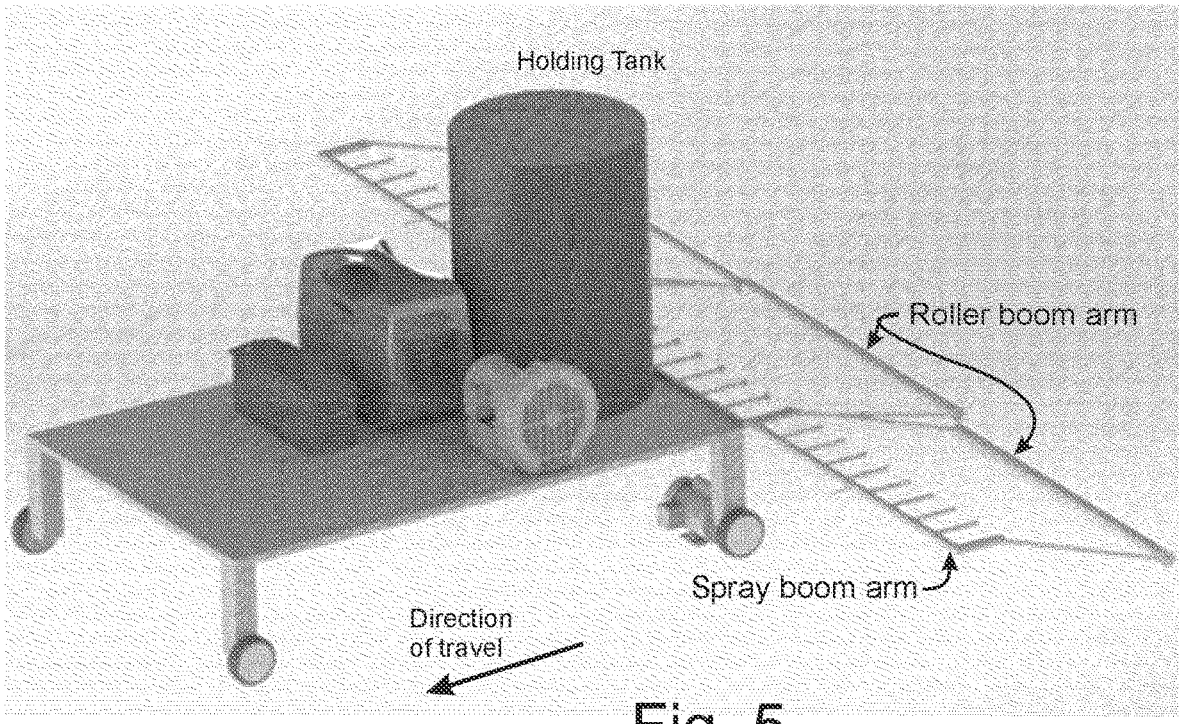
FIG. 5 illustrates a second alternative embodiment spray machine from a projected or isometric view showing spray boom arms that are configured to fold upward to avoid an obstacle.

In a similar manner, in some alternative embodiments the spray nozzles may for exemplary and non-limiting purpose comprise a plurality of spray nozzles fixed to the spray boom. In such case, the boom will most preferably be repositioned to avoid obstacles as required. This may in one embodiment be through a shift of the entire spray boom arm and selective control of the spray nozzles such as through appropriate valving. In another embodiment, the spray boom arm may be collapsible, such as from the in-line geometry illustrated in FIG. 1 to a "V" shaped geometry or in a further alternative embodiment with each of the left and right portions of the boom arm pivotal independently of the other, such as illustrated in the embodiment of FIG. 5.

As evident in FIG. 1, suitable sensors are preferably mounted adjacent to the ends of the spray boom arm. These sensors may be of any suitable type, including computer vision, Lidar and other laser sensors, ultrasonic sensors, and other types of proximity detectors. In the event an unexpected obstacle is about to be encountered, the boom arm sensors may then be used to adjust the boom arm to avoid many obstacles.

While not essential, cameras are preferred to provide a record of the area that has been coated.

To accommodate the borders and other obstacles such as the roof parapets, HVAC apparatus, vents, skylights and other roof penetrations, and the like on the roof, in some embodiments a processor will preferably access the available sensors and, optionally, a GPS or other location aware apparatus, and responsive thereto direct the movement of the spray machine, boom arms, and control the application of adhesive through the spray nozzles and rollers. A suitable system may for exemplary and non-limiting purpose comprise a computer vision system using visible light and appropriate software to detect and identify various roof features, and obstacles. However, in alternative embodiments, other types of sensors may be provided in addition or instead of a vision system. Again, for exemplary and non-limiting purpose an ultrasonic detector may be used to identify obstacles and assist with navigation. In some embodiments, various sensors will also preferably include apparatus capable of distinguishing adhesive-coated roof areas, for exemplary and non-limiting purposes such as with contrast-based vision sensors.

In addition, a preferred embodiment spray machine will be location aware. This may include a GPS position detector. In these instances where a GPS position detector is provided, the precision of detected GPS position may be improved through the use of a differential GPS system, where one or more fixed GPS position detectors are provided in the vicinity of and in communication with the spray machine to compare position information therewith. It is known that GPS and other satellite systems are subject to both accidental and intentional drift and variation. When a fixed position receiver is used near to the spray machine, then a sudden shift detected by both the spray machine and the fixed position receiver will be used to determine that there was, in fact, no such shift (the fixed position receiver has not moved). While GPS position detection is preferred, in other embodiments other suitable location aware technologies are implemented, including but not limited to radio time-of-flight or signal strength systems and the like.

In further embodiments where the spray machine is location aware, external apparatus may be used to program an area to be coated. The roof geometry may be known and mapped, and navigation controlled responsive to a map stored within memory provided within or in addition to the processor. Such a navigation system may preferably be provided within the preferred embodiment spray machine, but in alternative embodiments may be housed separately therefrom. Where a map and navigation system is used, the processor may guide the preferred embodiment spray machine about the roof. In such instance, input from the various sensors and location aware apparatus may be used to confirm positions anticipated by the processor, such as when approaching or moving adjacent to a parapet. Where a map is provided and used directly by the processor, the map may be retrieved from another device or apparatus and transferred through suitable communications to the processor for storage.

In order to provide map-based navigation, and whether the navigation is controlled entirely within the preferred embodiment spray machine or by apparatus external thereto, a communication channel is required. Exemplary communications might for exemplary and non-limiting purpose comprise wireless techniques such as Bluetooth™ wireless communications, Near-Field Communications (NFC), and other radio or optical communications, or direct electrical connections such as through a USB or other wired connection. Wireless techniques are most preferred, owing to the ready availability, low cost, and need for a durable communications channel even in the presence of errant adhesive and substantial weather exposure.

In those embodiments where a communications channel and a computer vision system are both provided, video from the vision system may be transmitted from the spray machine to a separate device. This may preferably be configured to enable a person to monitor the movements of the spray machine and to view the video from the vision system sensors. This combination greatly facilitates remote monitoring of the proper operation and progress of the spray machine. In some embodiments, the person may further control the movement and operation of the spray machine remotely.

Where desired, preferred and alternative embodiment spray machines may further be provided with suitable audio and visual notification apparatus to signal when the spray machine will be or is moving. Such notification apparatus may for exemplary and non-limiting purpose comprise a bell or chime and a light.

When the spray machine is location aware and provided with a suitable communications apparatus, more than one spray machine may be operated upon a single roof. In such instance, each one of the spray machines will preferably communicate with others, for exemplary purposes to communicate which area(s) still require adhesive coating such that when one spray machine needs to recharge, restock, or is otherwise out of commission, another spray machine may be advised where to travel to and continue the process, by providing suitable GPS coordinates and/or other information. Similarly, a roof may be subdivided into subsections, each subsection coated by a different one of the plurality of spray machines.

Figure 3:
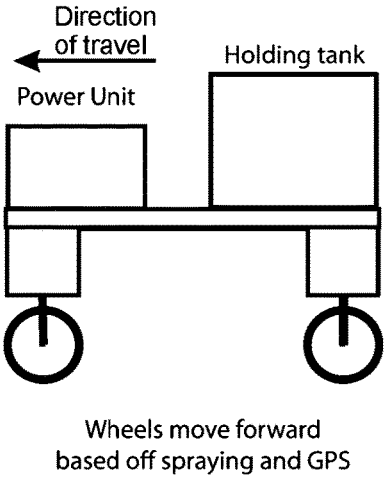
FIG. 3 illustrates the preferred embodiment spray machine from a side elevational and simplified view showing the drive train and undercarriage and with the spray and roll apparatus removed.

The spray and roll apparatus are supported on an undercarriage and propelled by a drive train such as illustrated for exemplary purpose in FIG. 3. The framework of the undercarriage is supported by wheels, some or all of which may be driven by the power unit. The power unit may comprise any suitable type or number of power sources, including for exemplary and non-limiting purpose an internal combustion engine, external combustion engine, an electrical motor, or electric motors for two or more of the wheels. The drive may be direct, particularly in the case of a plurality of electric motors, but will more typically include suitable transmission means either provided within the power unit or intermediate between the power unit and wheels. For exemplary and non-limiting purpose, suitable transmission means may include not only gearing but also differentials, and may be provided to either one or any number of wheels, as desired and appropriate at design time. Furthermore, the wheels in some embodiments may be individually supported and driven, and in other embodiments may be coupled together on common axles.

Most preferably, the wheels will be relatively large, both in diameter and in width. The large diameter will more readily permit the wheels to traverse any small obstacles, and the width will increase the surface area supporting the weight of the spray machine. While pneumatic wheels are preferred since they are generally less likely to damage the roof, in some alternative embodiments solid wheels may be provided, and in other alternative embodiments tracks similar to those used on some skid-steers, bulldozers, and tanks may be provided instead of wheels. In other alternative embodiments, other known apparatus for supporting and propelling the spray machine may be provided instead of wheels or tracks.

When the adhesive holding tank is emptied, which may for exemplary and non-limiting purpose be detected by one or more float, pressure, mass flow, or other sensors, or in the event a critical battery or other energy source becomes depleted, the spray machine is preferably configured to travel to a crane, recharge, or refill station where the spray machine may be refilled, recharged, or restocked.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

I claim:

1. A spray machine configured to spray an adhesive on a roof, comprising:

a sprayer boom arm defining a sprayer boom arm longitudinal axis;

a supply of said adhesive;

a sprayer supported on said sprayer boom arm, reciprocal along said sprayer boom arm longitudinal axis, and configured to receive said adhesive from said adhesive supply and spray said adhesive onto said roof;

a roller boom arm defining a roller boom arm longitudinal axis generally parallel to said sprayer boom arm longitudinal axis; and a roller supported on said roller boom arm, reciprocal along said roller boom arm longitudinal axis, and configured to spread said adhesive sprayed from said adhesive supply onto said roof;

means to convey said spray machine across a surface of said roof and thereby define an ordinary forward direction of travel, said sprayer boom arm longitudinal axis and said roller boom arm longitudinal axis each transverse to said ordinary forward direction of travel;

at least one applied adhesive sensor to detect applied adhesive; and at least one obstacle sensor to detect roof obstacles;

wherein said sprayer boom arm and said roller boom arm are each configured to extend and retract in a direction parallel to their respective longitudinal axes.

2. The spray machine of claim 1, further comprising an autonomous navigation system.

3. A spray machine having a leading sprayer and a trailing roller, conveyance means, and sensors, wherein said leading sprayer and said trailing roller are both supported on a boom arm, wherein said boom arm is configured to rotate about an axis parallel to a direction of conveyance of said spray machine, and lifted to avoid obstacles.

4. The spray machine of claim 1, wherein said roller rotates about an axis generally parallel to said ordinary forward direction of travel.

5. A spray machine configured to spray an adhesive on a roof, comprising:

a sprayer boom arm defining a sprayer boom arm longitudinal axis;

a supply of said adhesive;

a sprayer supported on said sprayer boom arm, reciprocal along said sprayer boom arm longitudinal axis, and configured to receive said adhesive from said adhesive supply and spray said adhesive onto said roof;

a roller boom arm defining a roller boom arm longitudinal axis generally parallel to said sprayer boom arm longitudinal axis; and a roller supported on said roller boom arm, reciprocal along said roller boom arm longitudinal axis, and configured to spread said adhesive sprayed from said adhesive supply onto said roof;

means to convey said spray machine across a surface of said roof and thereby define an ordinary forward direction of travel, said sprayer boom arm longitudinal axis and said roller boom arm longitudinal axis each transverse to said ordinary forward direction of travel;

at least one applied adhesive sensor to detect applied adhesive; and at least one obstacle sensor to detect roof obstacles;

wherein said sprayer boom arm and said roller boom arm are each configured to shift in a direction parallel to their respective longitudinal axes.

* * * * *